US009291423B2

(12) United States Patent
Leslie

(10) Patent No.: US 9,291,423 B2
(45) Date of Patent: Mar. 22, 2016

(54) HEATED, REMOVABLE, BATTERY POWERED FIREARM GRIP

(71) Applicant: Jimi Leslie, San Diego, CA (US)

(72) Inventor: Jimi Leslie, San Diego, CA (US)

( * ) Notice: Subject to any disclaimer, the term of this patent is extended or adjusted under 35 U.S.C. 154(b) by 0 days.

(21) Appl. No.: 14/159,175

(22) Filed: Jan. 20, 2014

(65) Prior Publication Data

US 2015/0369557 A1 Dec. 24, 2015

(51) Int. Cl.
*F41C 23/16* (2006.01)
*H05B 3/18* (2006.01)

(52) U.S. Cl.
CPC *F41C 23/16* (2013.01); *H05B 3/18* (2013.01); *Y10T 29/49119* (2015.01)

(58) Field of Classification Search
CPC ..... F41C 23/16; F41C 23/10
USPC ..... 42/84
See application file for complete search history.

(56) References Cited

U.S. PATENT DOCUMENTS 6,164,003 A 12/2000 Miller

*Primary Examiner* — Reginald Tillman, Jr.
(74) *Attorney, Agent, or Firm* — Kevin Keener; Keener and Associates P.C.

(57) ABSTRACT

The invention is directed toward a heated grip for a firearm. The heated firearm grip comprises a grip body, an electrically resistive heating element, and a power source. The grip body is shaped as a pistol style firearm grip, has a hollow internal cavity, and has a hinged lower lid located on the bottom of the grip body. The power source is located within the hollow internal cavity of the grip body and is electrically connected to the electrically resistive heating element. The grip body is interchangeable with the factory installed grip of a firearm. The electrically resistive heating element may be embedded in a polyurethane sleeve surrounding the external surface of the grip body. The electrically resistive heating element may also be located within the hollow internal cavity of the grip body or molded into the body of the grip body.

20 Claims, 8 Drawing Sheets

HEATED, REMOVABLE, BATTERY POWERED FIREARM GRIP

TECHNICAL FIELD

This invention relates generally to firearms and firearm components and more particularly to a system method for providing a heated firearm grip which may be interchanged between multiple receivers and firearms.

BACKGROUND

Most grips simply attach to the firearm and allow the user to handle and control the weapon. In extremely cold conditions a person's hands can become cold and stiff, restricting the movement of the hands and fingers. A person needs to have smooth and steady trigger control and maximum dexterity in order to shoot a firearm accurately. While gloves on the users' hands can help provide some warmth, they also restrict movement, dexterity and sensitivity. What is needed is a heated firearm grip that allows a user to retain more heat in their hands and fingers, decreasing the restrictive movement caused from gloves and the cold environment.

U.S. Pat. No. 6,164,003 on Dec. 26, 2000 to Miller shows a heated firearm stock which requires batteries held in the stock of the firearm to provide power to heat a portion of the stock surface. The Miller patent is limited in that it the heating element is limited to the shooting hand and the Miller patent does not teach the heating of the non-shooting hand. Additionally, the Miller patent teaches that only a portion of the grip of the firearm contains a heating element instead of the entire grip of the firearm. The Miller patent also requires the use of the entire stock of the firearm instead of only the grip of the firearm. What is needed is a system and method of heating a firearm grip without use of the firearm stock and that heats the entire surface of the firearm grip. In addition, what is needed is a heated firearm grip which is removable and interchangeable between multiple firearms.

SUMMARY OF THE INVENTION

The invention is directed toward a heated firearm grip. The heated firearm grip comprises a grip body, an electrically resistive heating element, and a power source. The grip body is shaped as a pistol style firearm grip, has a hollow internal cavity, and has a hinged lower lid located on the bottom of the grip body. The power source is located within the hollow internal cavity of the grip body and is electrically connected to the electrically resistive heating element. The grip body is interchangeable with the factory installed grip of a firearm.

In one embodiment of the invention the electrically resistive heating element is embedded in a polyurethane sleeve substantially surrounding the external surface of the grip body. In another embodiment of the invention the electrically resistive heating element is located within the hollow internal cavity of the grip body and is located between the power source and the internal surface of the hollow internal cavity of the grip body. In another embodiment of the invention the electrically resistive heating element is molded into the body of the grip body. In another embodiment of the invention the power source is a battery pack. In another embodiment of the invention the power source is a plurality of batteries. The hollow internal cavity of the grip body has a plurality of metal springs and a plurality of metal tabs. The plurality of metal springs and a plurality of metal tabs are electrically connected to the resistive heating element. The plurality of batteries are placed in series in connection with the plurality of metal springs and a plurality of metal tabs.

In another embodiment of the invention, the heated firearm grip further comprises a switch. The switch located on the hinged lower lid on the bottom of the grip body. The switch regulates the amperage of electricity flowing from the power source and through the electrically restrictive heating element. The switch has plurality of positions. Furthermore, in this embodiment of the invention, the electrically resistive heating element is embedded in a polyurethane sleeve substantially surrounding the external surface of the grip body. In an alternative version of this embodiment the electrically resistive heating element is located within the hollow internal cavity of the grip body and is located between the power source and the internal surface of the hollow internal cavity of the grip body. In an alternative version of this embodiment the electrically resistive heating element is molded into the body of the grip body.

In another embodiment of the invention the heated firearm grip further comprises a rechargeable cartridge. The rechargeable cartridge houses the electrically resistive heating element and the power source. The rechargeable cartridge may be connected to a recharging station to recharge the power source.

The invention is also directed toward a firearm having a heated grip comprising a grip body, a grip mount bolt, an electrically resistive heating element, and a power source.

The grip body is shaped as a pistol style firearm grip, has a hollow internal cavity, and has a hinged lower lid located on the bottom of the grip body. The power source is located within the hollow internal cavity of the grip body and is electrically connected to the electrically resistive heating element. The grip body is interchangeable with the factory installed grip of a firearm. The grip mount bolt passes through the hollow internal cavity of the grip body to removably secure the grip body to the firearm.

In one embodiment the firearm is a paintball gun. In another embodiment of the invention the firearm is a semiautomatic rifle. In another embodiment of the invention the electrically resistive heating element is embedded in a polyurethane sleeve substantially surrounding the external surface of the grip body. In another embodiment of the invention the electrically resistive heating element is located within the hollow internal cavity of the grip body and is located between the power source and the internal surface of the hollow internal cavity of the grip body.

In another embodiment of the invention the electrically resistive heating element is molded into the body of the grip body. Furthermore, this embodiment of the invention may further comprise a switch. The switch is located on the hinged lower lid on the bottom of the grip body and regulates the amperage of electricity flowing from the power source and through the electrically restrictive heating element. The switch has plurality of positions.

The invention is also directed toward a method for replacing a grip on a firearm with a heated grip. The method comprises removing a factory installed grip from the lower receiver of a firearm, connecting a grip body to the lower receiver of the firearm, and removably securing the grip body to the lower receiver of the firearm by means of a grip mount bolt. In this method the grip body is shaped as a pistol style firearm grip, has a hollow internal cavity, and has a hinged lower lid located on the bottom of the grip body. The hollow internal cavity houses a power source. The power source is electrically connected to an electrically resistive heating element. The grip mount bolt passes through the hollow internal cavity of the grip body to removably secure the grip body to the firearm.

In another embodiment of the method the grip body further comprises a switch. The switch is located on the hinged lower lid on the bottom of the grip body and regulates the amperage of electricity flowing from the power source and through the electrically restrictive heating element. The switch has plurality of positions

DETAILED DESCRIPTION

Figure 1:
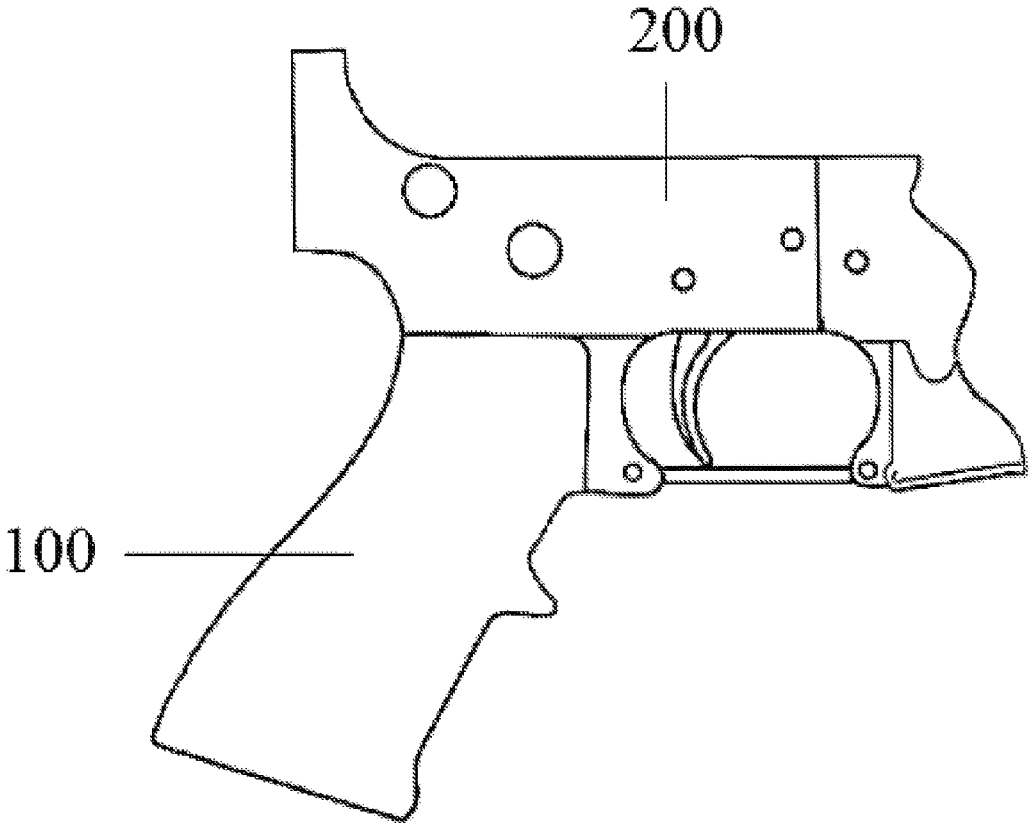
FIG. 1 is a side view of the grip installed on a firearm.

Although the present invention will be described with reference to the exemplary embodiments shown in the drawings, it should be understood that the present invention can be embodied in many alternate forms or embodiments. Alternative materials and designs may be used in the alternative forms and embodiments.

Figure 2:
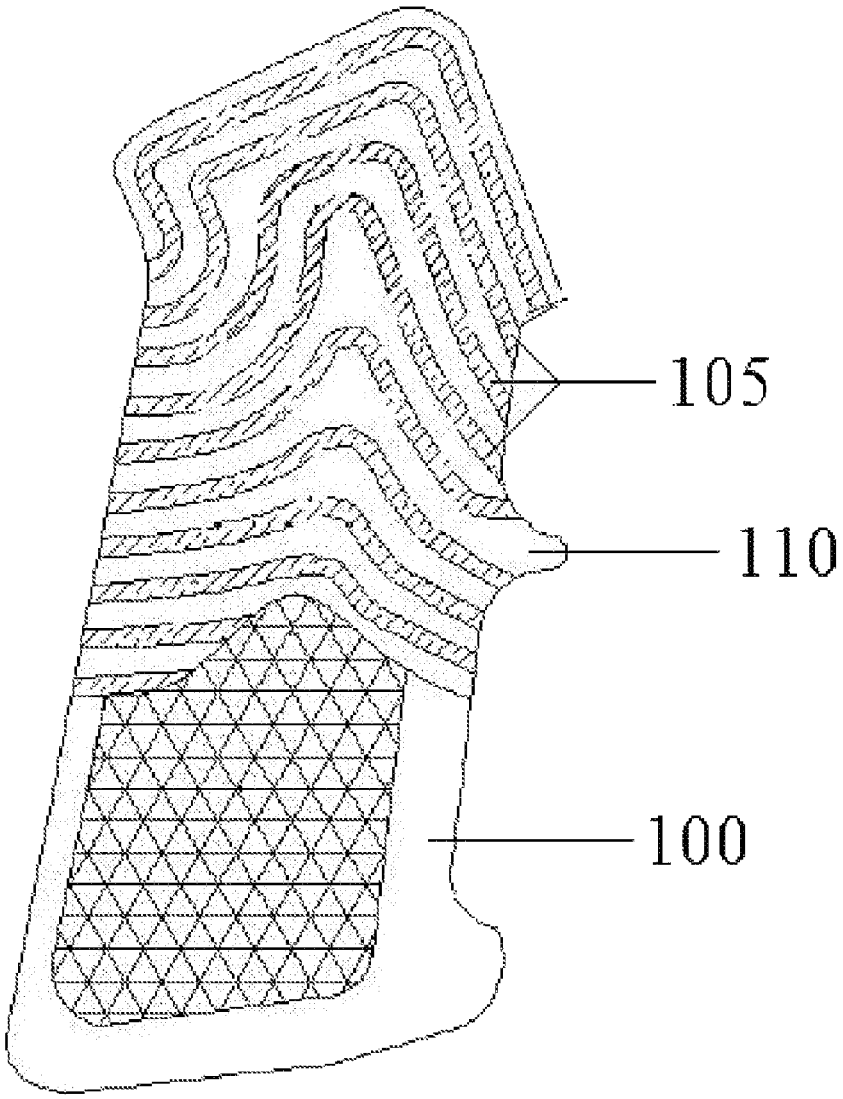
FIG. 2 is a side view of the grip with an external sleeve.

Referring to FIG. 1, the grip body 100 is attached to a firearm receiver 200. Referring to FIG. 2, one embodiment of the invention is displayed. In this embodiment the grip body 100 is covered by a polyurethane sleeve 110. Wound within the polyurethane sleeve 110 is a resistive wire 105. As electricity passes through the resistive wire 105, heat is produced. The heat passes through the polyurethane sleeve 110 to warm the hand of the user.

Figure 3:
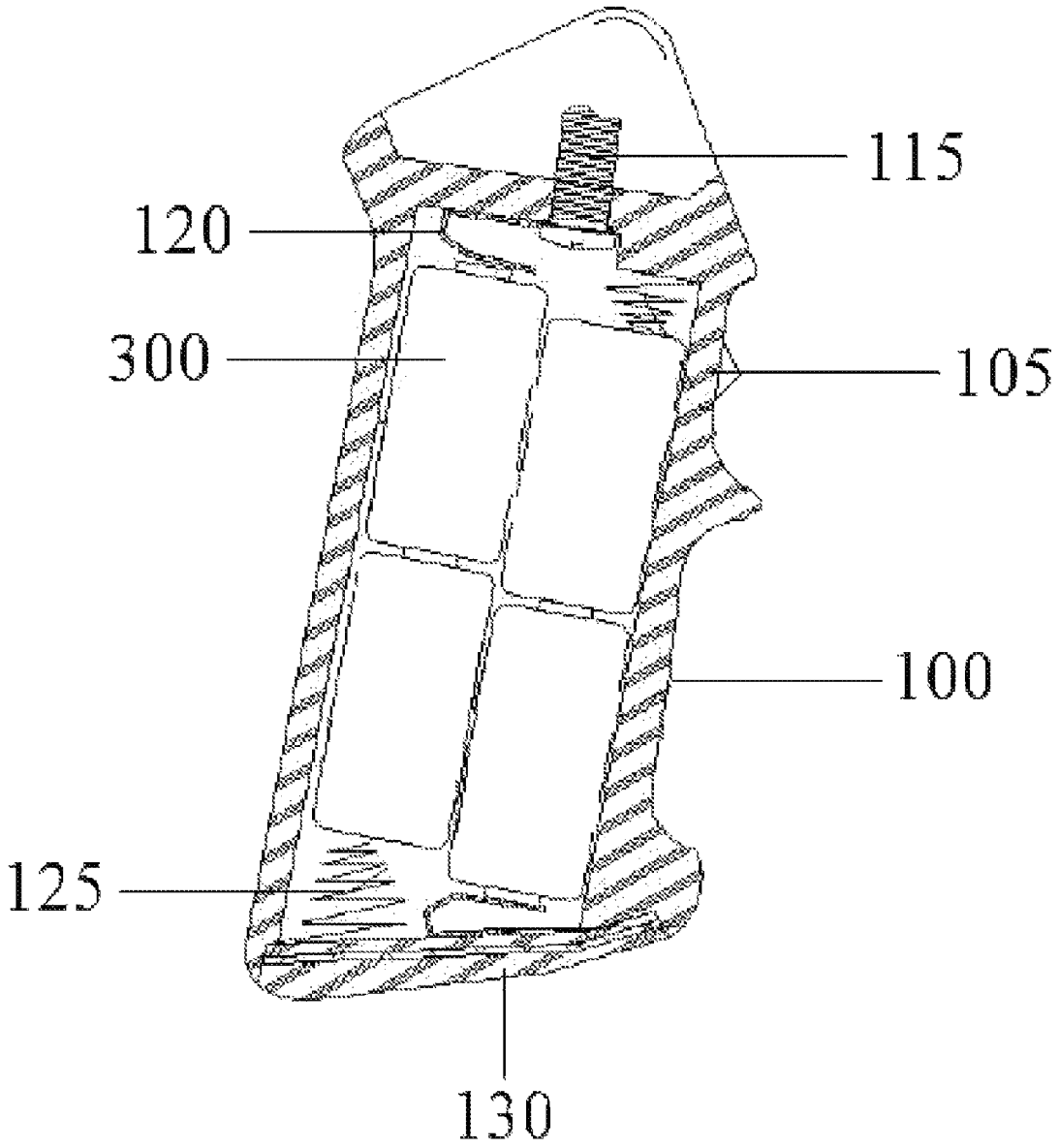
FIG. 3 is a cut away view of the grip.
Figure 4:
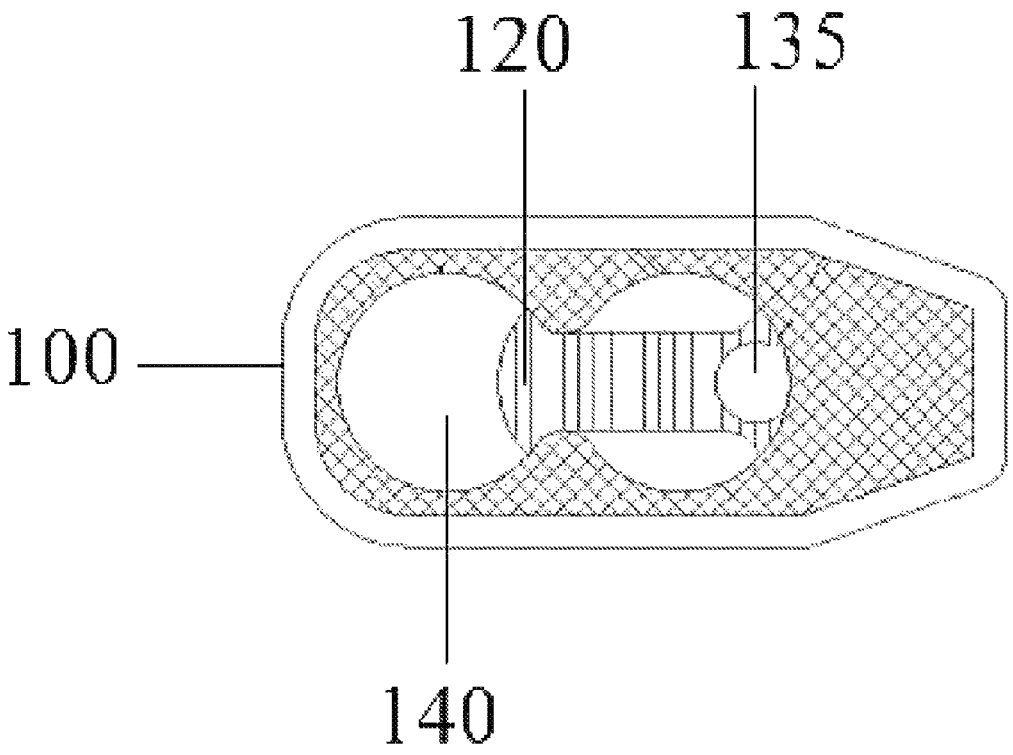
FIG. 4 is a bottom view of the grip.

Referring to FIG. 3 and FIG. 4, an alternative embodiment of the invention is displayed. In this embodiment, the resistive wire 105 is molded into the grip body 100. The grip body 100 is secured to the firearm receiver 200 by means of a grip mount bolt 115. The grip mount bolt 115 passes through the mount bolt hole 135 to removably secure the grip body 100 to the firearm receiver 200. The resistive wire 105 is powered by any number of batteries 300. The batteries are connected to the resistive wire 105 by springs 125 and contact tabs 120. The batteries 300 are held in an internal cavity 140 in the grip body 100. The batteries 300 are held in the internal cavity 140 by a bottom lid 130. The bottom lid 130 may have a spring 125 and a contact tab 120 connected to the bottom lid 130.

Figure 5:
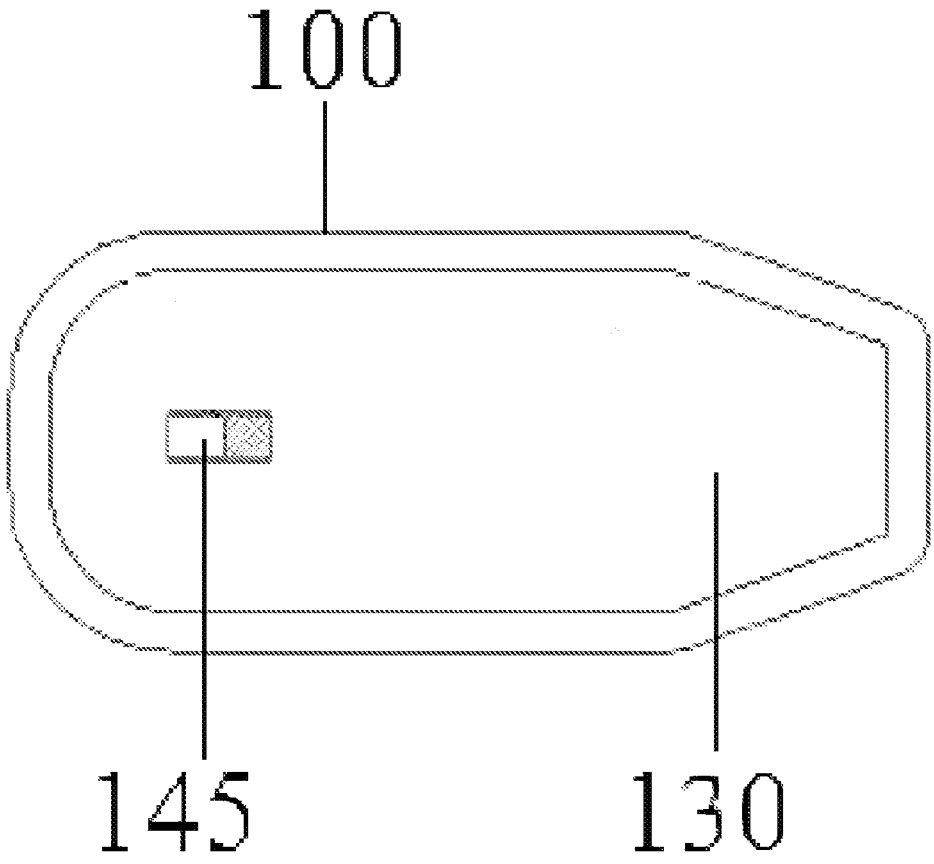
FIG. 5 is a bottom view of the grip.

Referring to FIG. 5, the bottom lid 130 has a switch 145. The switch 145 regulates the power level that runs through the resistive wire 105. The switch 145 may have any number of usable positions. The switch 145 has an "on" position and an "off" position. In the "on" position, electricity runs through the resistive wire 105 to produce heat. In the "off" position, the circuit is broken, no electricity passes through the resistive wire 105 and no heat is produced. The switch 145 may also have a "hi" position, a "medium" position, and a "low" position. These positions regulate the amount of electricity passing through the resistive wire 105 and thus the amount of heat produced by the resistive wire 105. The "hi" position allows the largest amount of electricity to pass through the resistive wire 105 and thus produce the most heat. The "low" position allows a minimal amount of electricity to pass through the resistive wire 105 and thus produce a minimum amount of heat. The "medium" position allows an amount of electricity to pass through the resistive wire 105 that is less than the amount from the "hi" position but more than the amount from the "low" position. This allows the resistive wire 105 to produce an intermediate amount of heat.

Figure 6:
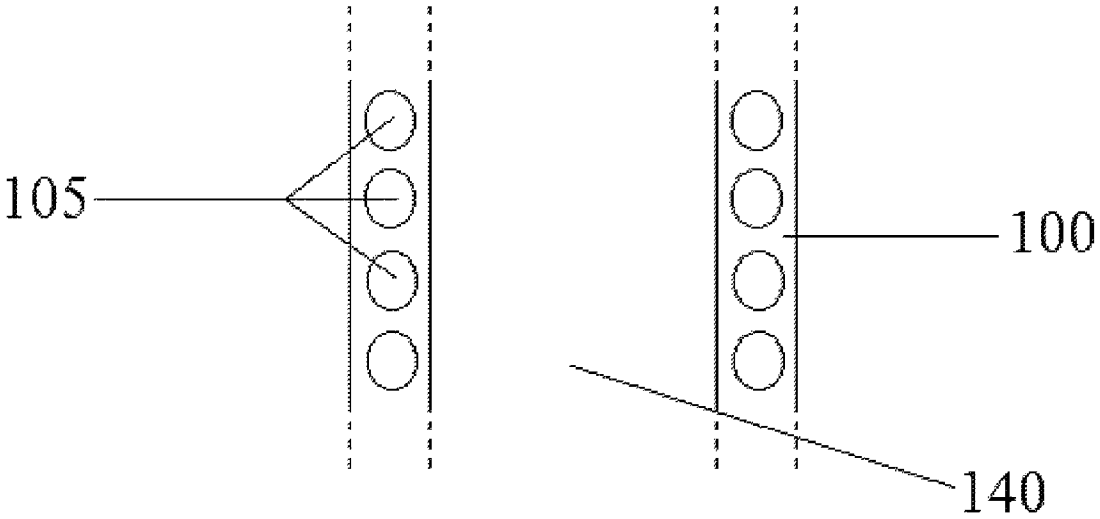
FIG. 6 is a cut away view of the grip.
Figure 7:
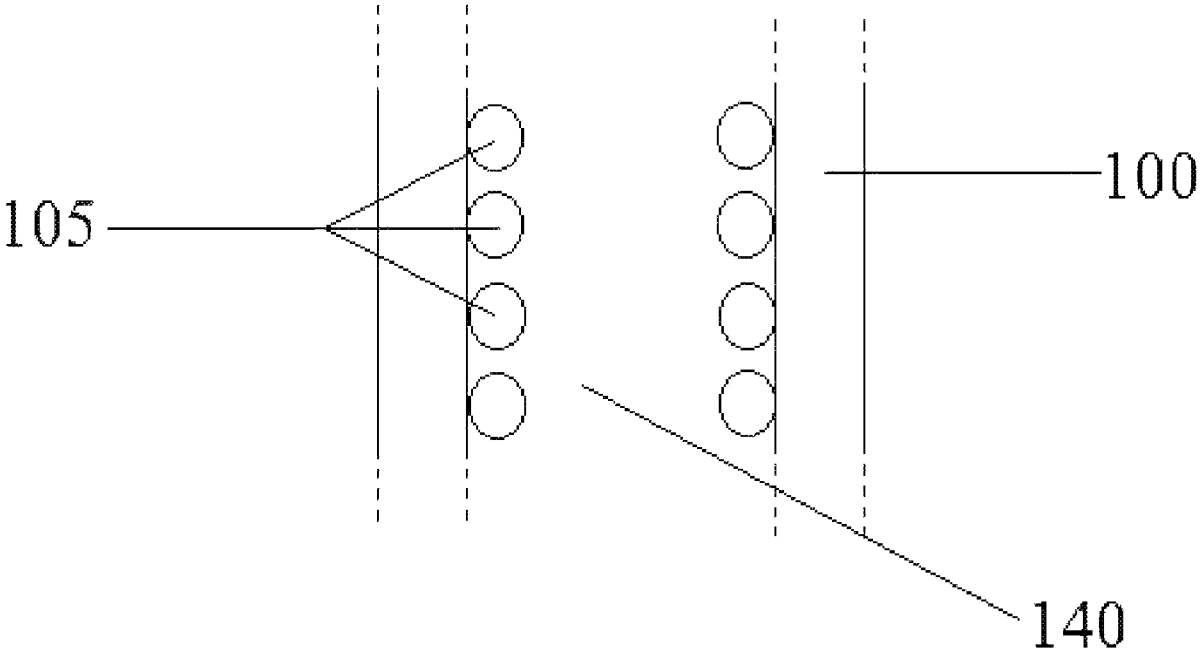
FIG. 7 is a cut away view of the grip.

Referring to FIG. 6, a close up view of the grip body 100 is displayed. In the embodiment displayed, the resistive wire 105 is molded into the grip body 100. As heat is produced by the resistive wire 105, the heat transfers into the grip body 100. Referring to FIG. 7, an alternative embodiment of the invention is displayed. In this embodiment, the resistive wire 105 is located within the internal cavity 140 of the grip body 100. In the displayed embodiment, the resistive wire 105 is in direct contact with the internal surface of the grip body 100 within the internal cavity 140.

Figure 8:
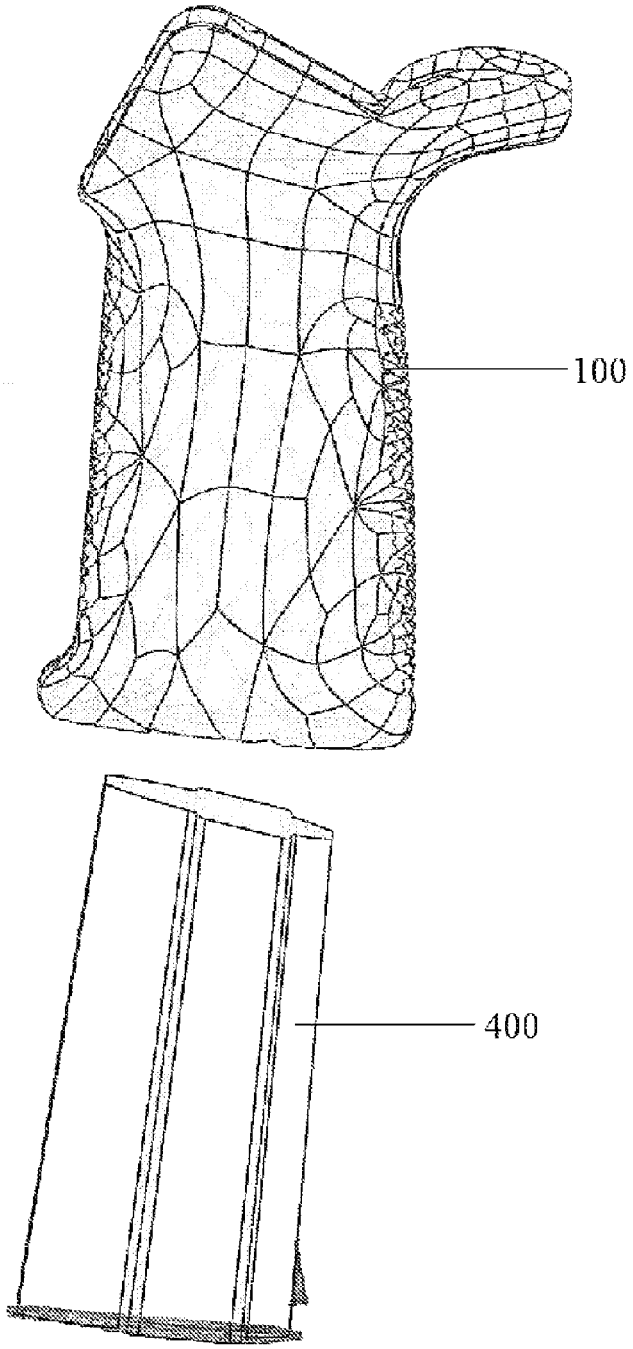
FIG. 8 is a perspective view of the grip with a rechargeable cartridge.

Referring to FIG. 8, an alternative embodiment of the invention is displayed. In this embodiment the functional components of the heating device are housed in a rechargeable cartridge 400. Within the rechargeable cartridge 400 are the resistive wire 105 and batteries 300. The rechargeable cartridge 400 can be inserted into the grip body 100. In this embodiment, the rechargeable cartridge 400 is inserted into the internal cavity 140 of the grip body 100. The rechargeable cartridge 400 may then be turned on to provide heat to the grip body 100. When not in use, a user may remove the rechargeable cartridge 400 and plug the rechargeable cartridge 400 into a charging station to recharge the batteries 300. A user may use multiple rechargeable cartridges 400. In this manner the user may use one rechargeable cartridge 400 in the grip body 100 while another rechargeable cartridge 400 is recharging its batteries 300 in a charging station.

A user can use utilize the invention on any firearm receiver 200 structured to receive a pistol style grip. To replace, a person removes the original factory installed grip. Then the person places the grip body 100 on the firearm receiver 200. The person then securely attaches the grip body 100 to the firearm receiver 200 by means of the grip mount bolt 115. The person screws the grip mount bolt 115 through the mount bolt hole 135 in the grip body 100. It is anticipated that the heated grip body 100 may be attached to any type of firearm, including but not limited to pistols, shotguns, assault rifles, and paintball guns.

The invention claimed is:

1. A heated firearm grip comprising
a grip body
  said grip body having a hollow internal cavity
  said grip body shaped as a pistol style firearm grip
  said grip body having a hinged lower lid located on the bottom of said grip body
an electrically resistive heating element
a power source
  wherein said power source is located within said hollow internal cavity of said grip body
  Wherein said power source is electrically connected to said electrically resistive heating element
wherein said grip body is interchangeable with the factory installed grip of a firearm.

2. The heated firearm grip as in claim 1
wherein said electrically resistive heating element is embedded in a polyurethane sleeve substantially surrounding the external surface of said grip body.

3. The heated firearm grip as in claim 1
wherein said electrically resistive heating element is located within said hollow internal cavity of said grip body wherein said electrically resistive heating element is located between said power source and the internal surface of said hollow internal cavity of said grip body.

4. The heated firearm grip as in claim 1 wherein said electrically resistive heating element is molded into the body of said grip body.

5. The heated firearm grip as in claim 1 wherein said power source is a battery pack.

6. The heated firearm grip as in claim 1 wherein the power source is a plurality of batteries wherein said hollow internal cavity of said grip body has a plurality of metal springs and a plurality of metal tabs wherein said plurality of batteries are placed in series in connection with said plurality of metal springs and a plurality of metal tabs wherein said plurality of metal springs and a plurality of metal tabs are electrically connected to said resistive heating element.

7. The heated firearm grip as in claim 1 further comprising a switch said switch located on the hinged lower lid on the bottom of said grip body said switch regulating the amperage of electricity flowing from the power source and through said electrically restrictive heating element wherein said switch has plurality of positions.

8. The heated firearm grip as in claim 7 wherein said electrically resistive heating element is embedded in a polyurethane sleeve substantially surrounding the external surface of said grip body.

9. The heated firearm grip as in claim 7 wherein said electrically resistive heating element is located within said hollow internal cavity of said grip body wherein said electrically resistive heating element is located between said power source and the internal surface of said hollow internal cavity of said grip body.

10. The heated firearm grip as in claim 7 wherein said electrically resistive heating element is molded into the body of said grip body.

11. The heated firearm grip as in claim 1 further comprising a rechargeable cartridge wherein said rechargeable cartridge houses said electrically resistive heating element and said power source wherein said rechargeable cartridge may be connected to a recharging station to recharge said power source.

12. A firearm having a heated grip comprising a grip body said grip body having a hollow internal cavity said grip body shaped as a pistol style firearm grip said grip body having a hinged lower lid located on the bottom of said grip body A grip mount bolt wherein said grip mount bolt passes through said hollow internal cavity of said grip body to removably secure said grip body to said firearm an electrically resistive heating element a power source wherein said power source is located within said hollow internal cavity of said grip body wherein said power source is electrically connected to said electrically resistive heating element.

13. The firearm as in claim 12 wherein said firearm is a paintball gun.

14. The firearm as in claim 12 wherein said firearm is a semiautomatic rifle.

15. The firearm as in claim 12 wherein said electrically resistive heating element is embedded in a polyurethane sleeve substantially surrounding the external surface of said grip body.

16. The firearm as in claim 12 wherein said electrically resistive heating element is located within said hollow internal cavity of said grip body wherein said electrically resistive heating element is located between said power source and the internal surface of said hollow internal cavity of said grip body.

17. The firearm as in claim 12 wherein said electrically resistive heating element is molded into the body of said grip body.

18. The firearm as in claim 12 further comprising a switch said switch located on the hinged lower lid on the bottom of said grip body said switch regulating the amperage of electricity flowing from the power source and through said electrically restrictive heating element wherein said switch has plurality of positions.

19. A method of replacing a grip on a firearm with a heated grip comprising removing a factory installed grip from the lower receiver of a firearm connecting a grip body to the lower receiver of said firearm said grip body having a hollow internal cavity said hollow internal cavity housing a power source wherein said power source is electrically connected to an electrically resistive heating element said grip body shaped as a pistol style firearm grip said grip body having a hinged lower lid located on the bottom of said grip body removably securing said grip body to said lower receiver of said firearm by means of a grip mount bolt wherein said grip mount bolt passes through said hollow internal cavity of said grip body to removably secure said grip body to said firearm.

20. The method as in claim 19 wherein said grip body further comprises a switch said switch located on the hinged lower lid on the bottom of said grip body said switch regulating the amperage of electricity flowing from the power source and through said electrically restrictive heating element wherein said switch has plurality of positions.

* * * * *